United States Patent [19]

Knowles

[11] 4,092,939

[45] June 6, 1978

[54] TENSION DISC ASSEMBLY

[75] Inventor: Warren Dean Knowles, Clark, N.J.

[73] Assignee: The Singer Company, New York, N.Y.

[21] Appl. No.: 754,291

[22] Filed: Dec. 27, 1976

[51] Int. Cl.[2] ..... D05B 47/00

[52] U.S. Cl. ..... 112/254

[58] Field of Search ..... 112/59, 254, 97; 29/520; 226/195; 242/147 R, 150 R

[56] References Cited

U.S. PATENT DOCUMENTS

| | | | |
|---|---|---|---|
| 44,720 | 10/1864 | Gritzner | 112/254 |
| 2,707,322 | 5/1955 | Strain et al. | 29/520 X |
| 3,366,083 | 1/1968 | Ketterer et al. | 112/254 |
| 3,927,631 | 12/1975 | Kuhar | 112/254 |

FOREIGN PATENT DOCUMENTS

| | | | |
|---|---|---|---|
| 642,650 | 6/1962 | Canada | 112/254 |

*Primary Examiner*—Werner H. Schroeder
*Assistant Examiner*—Moshe I. Cohen
*Attorney, Agent, or Firm*—Robert E. Smith; Edward L. Bell; Julian Falk

[57] ABSTRACT

A tension disc assembly for tension devices, used for controlling thread on sewing machines, which is formed with a relatively large supporting frame into which a hardened tension disc is secured. The supporting frame allows the use of a standard-sized tension disc while serving as a guide for threading single and multi thread tension devices.

6 Claims, 3 Drawing Figures

TENSION DISC ASSEMBLY

BACKGROUND OF THE INVENTION

At present, there are numerous methods for insuring proper insertion of thread into thread tension devices. Many of these methods employ guides separate from the tension device itself for urging threads between various sets of tension discs. While these devices perform their function with reasonable success, the mere fact that they are separate from the tension discs leaves room for possible failure. Another prior art approach to solution of these problems is disclosed for instance in the U.S. Pat. No. 3,841,248 of Adams et al., which teaches that by enlarging one of the tension discs, the same function as that performed by the separate guides may be achieved, i.e., guiding thread between the tension discs. Enlarging one of the tension discs, however, is expensive because a tension disc requires costly hardening and polishing. Moreover, this patented approach entails the costly manufacture of at least two sizes of tension discs.

SUMMARY OF THE INVENTION

The object of this invention is to provide a tension disc assembly which performs the same functions as the enlarged tension discs without the need for manufacturing two different sizes of tension discs. This object is achieved by forming a relatively large supporting structure out of an inexpensive material and then securing in said structure a standard-sized tension disc.

With the above and additional objects and advantages in view as will hereinafter appear, this invention will be described with reference to the accompanying drawings of the preferred embodiment.

DESCRIPTION OF THE PREFERRED EMBODIMENT

Figure 1:
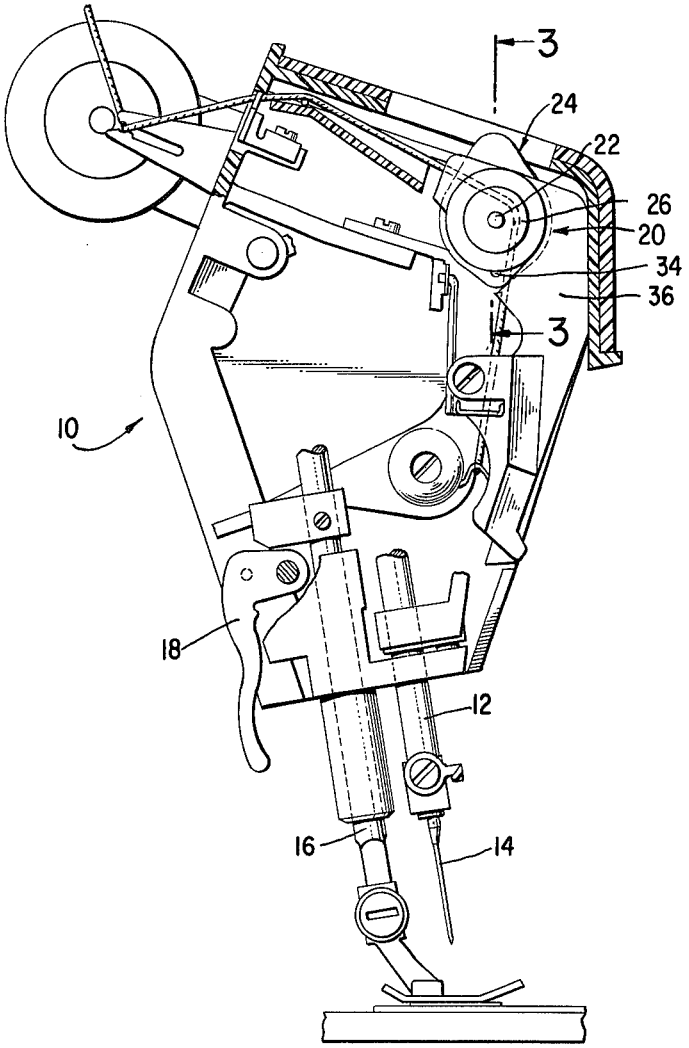
FIG. 1 is a front elevation of the sewing head of a sewing machine incorporating the invention.

The present invention is disclosed as embodied in the needle thread tension of a sewing machine. Referring to FIG. 1 of the drawing, a sewing machine head is generally referred to by the reference number 10. The sewing machine head 10 includes a reciprocatory needle bar 12 having a needle 14 attached thereto, and a presser foot assembly 16 along with a presser foot lifter mechanism 18. The sewing machine head 10 also includes a tension device 20.

The tension device 20 has a central shaft 22, on which tension discs, along with the tension disc assembly 24 of this invention, are mounted, a locking nut 26 mounted on the end of the shaft 22 and means (not shown) for providing a compressive force to the tension discs.

The tension disc assembly 24 is formed of a plate 28 having an aperture 30 therein for receiving a standard-sized tension disc 32. The over-all size and shape of the plate 28 is arbitruary and may be tailored to suit any particular application. In the subject embodiment, the plate 28 is also formed with a hole 33 so positioned as to fit over a locating pin 34 mounted in the tension device frame 36 thereby preventing the tension disc assembly 24 from rotating while in use.

Figure 2:
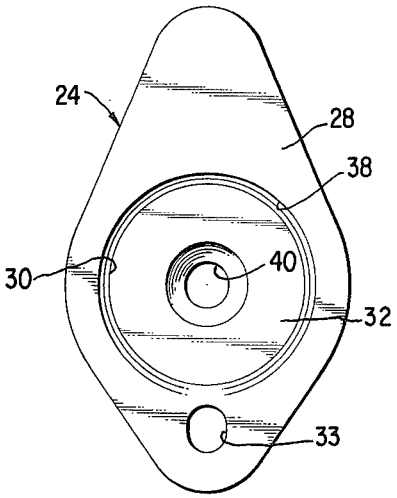
FIG. 2 is a front elevation of the tension disc assembly.
Figure 3:
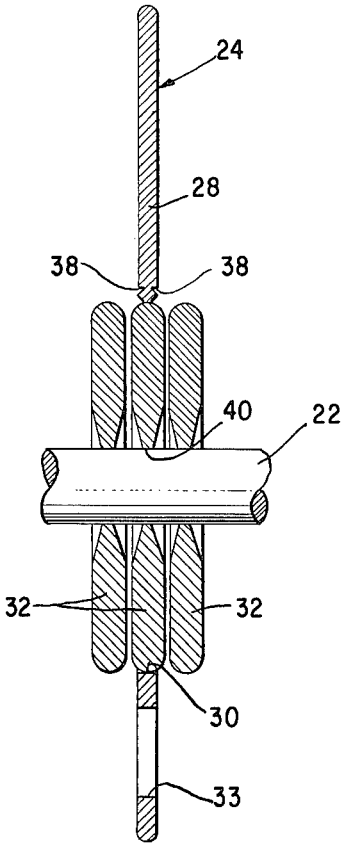
FIG. 3 is an enlarged cross-sectional view of a portion of a tension device taken along the line 3—3 of FIG. 1 showing the tension disc assembly of this invention in relation to the other tension discs within the tension device.

The tension disc 32 may be mounted in the aperture 30 of the plate 28 by any suitable means. FIGS. 2 and 3 show the tension disc 32 mounted to the plate 28 by staking the plate 28 substantially around the periphery of the aperture 30; the staking line being identified by the number 38.

The tension disc 32 is circular and has a centrally located aperture 40 for receiving the shaft 22. The size of the tension disc 32 is the same as that of the other tension discs used in the tension device 20 thereby allowing all the discs to be manufactured to the same specification.

For ease in threading the tension device 20, the plate 28 should have a thickness somewhat less than that of the tension disc 32.

Having thus described the nature of the invention, what I claim herein is:

1. A tension disc assembly, for use in a tension device in conjunction with individual, uniformly shaped tension discs, comprising:

one of said uniformly shaped tension discs;

a rigid flat plate having an aperture therethrough, said aperture having a shape congruent to the shape of said one tension disc; and, means for mounting said one tension disc within said aperture whereby said plate augments the size of said one tension disc enabling said plate with said one tension disc mounted therein to be used as an assembly both for guiding thread into said tension device and for tensioning thread therein.

2. A tension disc assembly as set forth in claim 1 wherein the cross-sectional thickness of said plate is less than that of said disc.

3. A tension disc assembly as set forth in claim 1 wherein said disc is formed with a centrally located hole for mounting said tension disc assembly in a thread tension device.

4. A tension disc assembly as set forth in claim 1 wherein said plate is further formed with a hole adjacent to said aperture whereby said hole will engage a locating pin within a thread tension device for preventing said tension disc assembly from rotating.

5. A tension disc assembly as set forth in claim 1 wherein said mounting means comprises staking said plate substantially around said aperture.

6. A thread tension device for a sewing machine capable of tensioning two different threads simultaneously comprising at least three thread engaging tension discs arranged in side by side relation, each of said discs having identical peripheral contour, the centrally located of said discs having a plate attached thereto, said plate having a lesser thickness than said disc and extending outwardly beyond the peripheral contour of said disc whereby when thread is brought to the tension device said plate would guide the thread selectively between said central disc to which said plate is attached and either one of said other discs.

* * * * *